United States Patent [19]

Neister

[11] 4,250,427

[45] Feb. 10, 1981

[54] DYE LASER FLASHLAMP AND METHOD OF MAKING SAME

[76] Inventor: S. Edward Neister, Box G-2, New Durham, N.H. 03855

[21] Appl. No.: 959,755

[22] Filed: Nov. 13, 1978

[51] Int. Cl.[3] ..... H01J 17/16; H01J 17/18; H01J 61/30

[52] U.S. Cl. ..... 313/217; 313/220

[58] Field of Search ..... 313/217, 220

[56] References Cited

U.S. PATENT DOCUMENTS

| | | | |
|---|---|---|---|
| 3,262,004 | 7/1966 | Keller | 313/220 |
| 3,721,851 | 3/1973 | Ceccon et al. | 313/220 X |
| 3,787,780 | 1/1974 | Powell | 313/220 X |
| 3,798,486 | 3/1974 | Hernquist | 313/220 |
| 3,936,767 | 2/1976 | Besson et al. | 313/220 X |

*Primary Examiner*—Robert Segal

*Attorney, Agent, or Firm*—Le Blanc, Nolan, Shur & Nies

[57] ABSTRACT

A coaxial dye laser flashlamp, each electrode of which is made of spaced rings joined by several molybdenum strips evenly spaced about and between the coaxial quartz tubes of the flashlamp. The coaxial quartz tubes are then fused together in the regions of the molybdenum strips.

3 Claims, 2 Drawing Figures

DYE LASER FLASHLAMP AND METHOD OF MAKING SAME

BACKGROUND OF THE INVENTION

The invention relates to coaxial dye laser flashlamps and more particularly to the electrodes of such flashlamps.

Such flashlamps include spaced, concentrically arranged tubes of different diameter so as to provide an annular space between the tubes. Circumferentially arranged ring electrodes are located at each end of the tubes and are sealed between the tubes with cement or a graded glass seal. The thus sealed and isolated annular space between the two tubes is then filled with xenon gas. One ring electrode is grounded and the other is subjected to an electrical charge. The charge travels through the xenon gas causing the emission of a bright flash.

The major problem with the above described prior art methods of sealing the electrodes to the tubes is that undesirable substances are introduced into the closed annular gas filled space between the tubes regardless of which method is used. The result is a much shortened lamp life.

The present invention overcomes this deficiency by provision of a series of equally spaced molybdenum strips which have ring electrodes attached to each end. Two of these assemblies are then arranged at each end of and between the tubes. The tubes are then heat fused together in the region of the strips to produce a satisfactory seal.

SUMMARY OF THE INVENTION

Accordingly, it is a principal object of the invention to provide a method of making a coaxial flashlamp wherein foreign substances are not introduced into the sealed annular space between the tubes making up the flashlamp to thus produce a flashlamp having a prolonged lamp life.

It is another object of the invention to provide a method of making a coaxial flashlamp without cement or a graded glass seal in the vicinity of the lamp electrodes.

It is a further object of the invention to provide a coaxial flashlamp wherein each electrode includes a series of evenly circumferentially spaced strips of molybdenum arranged parallel the axis of the tubes making up the flashlamp, the ends of each set of strips being joined by metal rings about the flashlamp inner tube.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings in which.

DESCRIPTION OF THE PREFERRED EMBODIMENT

Figure 1:
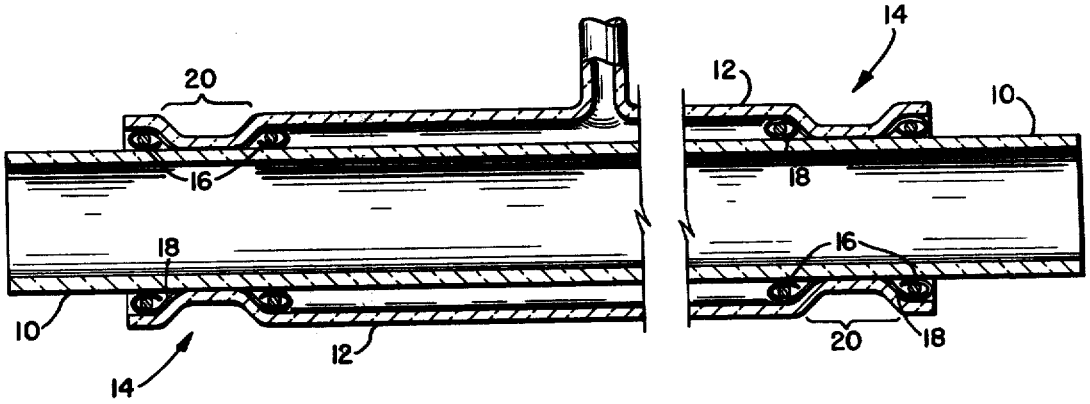
FIG. 1 is a partial, longitudinal section view through the axis of a flashlamp made in accordance with the teachings of this invention.
Figure 2:
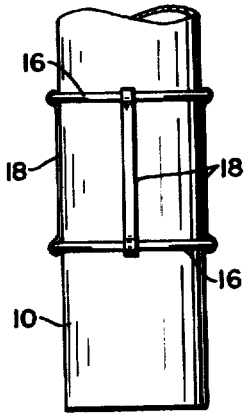
FIG. 2 is a plan, detail view of one end of the flashlamp inner tube with an electrode arranged thereon prior to placement and fusing of the second, outer tube.

FIG. 1 illustrates a coaxial flashlamp having an interior quartz tube 10 of extended length, an outer tube 12 of shorter length and larger diameter than inner tube 10 and concentrically arranged thereon, and a pair of electrodes 14 at each end thereof. Referring to FIG. 2, each electrode 14 is made up of a pair of rings 16 joined by a series of equally circumferentially spaced strips of molybdenum 18 having their outer ends curled over and attached to respective rings 16.

The method of making the flashlamp according to the instant invention involves, first, arranging an electrode at and over each end of inner quartz tube 10, as illustrated in FIG. 1. Thereafter, outer quartz tube 12 is arranged over tube 10 and circumferential band regions 20 at each end of tube 12 are then heat fused onto tube 10, over molybdenum strips 18 so that one ring 16 is positioned interiorly of a sealed annular space 22 defined by tubes 10, 12 as shown in FIG. 1 and one ring 16 is left outside of annular space 22. Thereafter, annular space 22 is filled with xenon gas by means of a filler tube 24. The heat fusion step provides a most satisfactorily sealed annular space 22 without any possibility of foreign substances entering space 22 as is the case with known prior art methods. Accordingly, the flashlamp has a prolonged lamp life when compared with prior art flashlamps.

The invention may be embodied in other specific forms without departing from the spirit of essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of making a coaxial flashlamp having spaced apart, concentrically arranged, inner and outer quartz tubes of different diameters and electrodes at each end of the tubes comprising the steps of: arranging a series of evenly circumferentially spaced strips of molybdenum joined at the strip ends by a pair of rings about the inner quartz tube at each end thereof; arranging the outer tube over the inner tube so that the strip ends of the outer tube overlay the arranged molybdenum strips; and circumferentially heat fusing the quartz tubes together in the regions of the molybdenum strips to form an impervious seal between the two tubes in the vicinity of the arranged molydenum strips.

2. The product of the process of claim 1.

3. The coaxial flashlamp comprising: an inner tube of quartz; an outer tube of quartz concentrically arranged about said inner tube so as to form an annular space between said tubes; annular reduced regions in said outer tube formed at each end thereof; a series of evenly circumferentially spaced sets of molybdenum strips arranged parallel to the axis of said tubes said annular reduced regions, molybdenum strips, and inner tube being fused together each strip having ends extending into said annular space and outwardly of said reduced regions said flashlamp further comprising a pair of metal rings at each end, one metal ring being attached to the ends of said molybdenum strips located within said annular space and the other metal ring being attached to the ends of said molybdenum strips extending outwardly of said reduced regions.

* * * * *